United States Patent [19]

Oda et al.

[11] Patent Number: 4,597,837

[45] Date of Patent: Jul. 1, 1986

[54] METHOD AND APPARATUS FOR ELECTROLYTIC TREATMENT

[75] Inventors: Kazutaka Oda; Yoshio Kon; Tsutomu Kakei, all of Shizuoka, Japan

[73] Assignee: Fuji Photo Film Co., Ltd., Kanagawa, Japan

[21] Appl. No.: 647,517

[22] Filed: Sep. 5, 1984

[30] Foreign Application Priority Data

Sep. 5, 1983 [JP] Japan ..... 58-162937

[51] Int. Cl.[4] ..... C25D 17/00; C25F 7/00

[52] U.S. Cl. ..... 204/14.1; 204/28; 204/129.43; 204/130; 204/211; 204/231; 204/DIG. 9

[58] Field of Search ..... 204/28, 206–211, 204/231, 14.1, 129.43, 130, DIG. 9

[56] References Cited

U.S. PATENT DOCUMENTS

| | | | |
|---|---|---|---|
| 2,901,412 | 8/1959 | Mostovych | 204/211 |
| 2,951,025 | 8/1960 | Mostovych | 204/211 |
| 4,087,341 | 5/1978 | Takahashi et al. | 204/129.43 |
| 4,214,961 | 7/1980 | Anthony | 204/211 |
| 4,294,672 | 10/1981 | Ohba | 204/DIG. 9 |
| 4,297,184 | 10/1981 | Dyer | 204/DIG. 9 |
| 4,315,806 | 2/1982 | Arora | 204/129.43 |

*Primary Examiner*—John F. Niebling
*Assistant Examiner*—William T. Leader
*Attorney, Agent, or Firm*—Sughrue, Mion, Zinn, Macpeak, and Seas

[57] ABSTRACT

A method and apparatus for electrolytic treatment employing graphite electrodes wherein an asymmetrical waveform alternating current is applied to the electrodes to subject a metal web to a continuous electrolytic treatment. A graphite electrode in a treatment section is arranged confronting the metal web. Two graphite electrodes in current supply sections are arranged respectively upstream and downstream of the graphite electrode in the treatment section relative to a direction of movement of the metal web. Two auxiliary anode electrodes in the current supply sections are arranged respectively upstream and downstream of the two graphite electrodes in current supply sections. A part of an asymmetrical alternating waveform current is supplied to the auxiliary anode electrodes so that a current causing a cathode reaction on the surfaces of the graphite electrodes is made larger than a current causing an anode reaction thereon.

10 Claims, 4 Drawing Figures

| | | |
|---|---|---|
| (1) | DIRECT CURRENT WAVEFORM |   |
| (2) | SYMMETRIC ALTERNATE CURRENT WAVEFORM |   |
| (3) | ASYMMETRIC ALTERNATE CURRENT WAVEFORM |   |
| (4) | ASYMMETRIC ALTERNATE CURRENT WAVEFORM |   |
| (5) | ASYMMETRIC ALTERNATE CURRENT WAVEFORM (SQUARE - WAVE ) |   |
| (6) | ASYMMETRIC ALTERNATE CURRENT WAVEFORM (SQUARE - WAVE ) |   |

METHOD AND APPARATUS FOR ELECTROLYTIC TREATMENT

BACKGROUND OF THE INVENTION

The present invention relates to a method and an apparatus for electrolytic treatment of the surface of metal web in which the stability of the electrodes is improved.

Examples of methods of applying an electrolytic treatment to the surface of a metal member made of aluminum, iron or the like are the plating method, the electrolytic roughening method, the electrolytic etching method, the anodic oxidation method, the electrolytic coloring method, and the electrolytic satin finishing method, all which have been extensively employed in the art. D.C. sources, A.C. sources, superposed-waveform current sources, and thyristor-controlled special-waveform or square-wave A.C. sources have been employed with these methods in order to meet quality requirements of the electrolytic treatment or to improve the reaction efficiency. For instance, U.S. Pat. No. 4,087,341 discloses a process in which an A.C. current is applied in the electrolytic treatment of an aluminum plate with the voltage applied to the anode electrode being higher than the applied to the cathode electrode, whereby aluminum substrates for lithographic printing whose surfaces are satisfactorily electrograined are obtained. When using regulated A.C. current, it is essential to employ electrodes which are highly stable. In general, platinum, tantalum, titanium, iron, lead and graphite are employed as electrode materials. Graphite electrodes are widely employed because they are chemically relatively stable and are of low cost.

FIG. 1 shows an example of a conventional continuous electrolytic treatment system for metal webs which utilizes graphite electrodes. In this system, a metal web 1 is introduced into an electrolytic cell 3 while being guided by a guide roll 2, and is conveyed horizontally through the cell while being supported by a roll. Finally, the web 1 is moved out of the cell passing around a guide roll 4. The electrolytic cell is divided by an insulator 6 into two chambers in which graphite electrodes are arranged on both sides of the metal web 1. A supply of electrolytic solution 9 is stored in a tank 10. A pump 11 supplies the electrolytic solution to electrolytic solution supplying pipes 12 which debouch into the electrolytic cell. The electrolytic solution thus supplied covers the graphite electrodes 7 and 8 and the metal web and then returns to the tank 10 through a discharging pipe 13. A power source 14 connected to the graphite electrodes 7 and 8 applies a voltage thereto. An electrolytic treatment can be continuously applied to the metal web 1 with this system.

The power source 14 may produce (1) direct current, (2) a symmetric alternating current waveform, (3) and (4) an asymmetric alternating current waveform, and (5) and (6) an asymmetric square-wave alternate current waveform as shown in FIG. 2. In general, with the A.C. waveform, the average value of the forward current $I_n$ is not equal to the average value of the reverse current $I_r$.

A graphite electrode is considerably stable when used a cathode electrode. However, when a graphite electrode is used as an anode electrode, it is consumed in the electrolytic solution, forming $CO_2$ by anode oxidation and, at the same time, it decays due to erosion of the graphite interlayers, which occurs at a rate depending on electrolytic conditions. When decay occurs, the current distribution in the electrode changes so that the electrolytic treatment becomes nonuniform. Therefore, the occurrence of such a phenomenon should be avoided in a case where the electrolytic treatment must be performed with high accuracy. Accordingly, it is necessary to replace the electrodes periodically. This requirement is a drawback in mass production, and is one of the factors which lowers productivity.

An object of the invention is to provide an electrolytic treatment method in which, based on the properties of graphite, the electrodes are maintained sufficiently stable even in electrolytic treatment using an asymmetric A.C. waveform.

SUMMARY OF THE INVENTION

The inventors have conducted intensive research regarding ways to prevent the consumption of graphite electrodes, and have found conditions under which graphite electrodes employed in a system using an asymmetric A.C. waveform can be stabilized. Specifically, in the electrolytic cell shown in FIG. 1, an asymmetric waveform current ($I_n > I_r$) as shown at (4) in FIG. 2 was used. The forward terminal was connected to the electrode 7 and the reverse terminal to the electrode 8. Under these conditions, an electrolytic treatment was carried out using a 1% HCl electrolytic bath with a current density of 50 A/dm$^2$ and a frequency of 60 Hz. In this case, the graphite electrode 7 was consumed quickly, while when the connection of the terminals was reversed, the electrode 8 was consumed but not the electrode 7. This means that, for the use of an asymmetric waveform current, the graphite electrode is consumed when $I_{anode} > I_{cathode}$, and it is not consumed when $I_{anode} < I_{cathode}$, where $I_{anode}$ is the current value in the periods in which the graphite electrode electrochemically acts as an anode electrode and $I_{cathode}$ is the current value in the periods in which the graphite electrode electrochemically acts as a cathode electrode.

More specifically, in the method and apparatus for electrolytic treatment of the invention in which graphite electrodes are used and an asymmetrical waveform alternating current is employed to subject a metal web to a continuous electrolytic treatment, a graphite electrode in the treatment section is arranged confronting the metal web, two graphite electrodes in current supply sections are arranged respectively upstream and downstream of the graphite electrode in the treatment section as viewed in the direction of movement of the metal web, and two current supply section anode electrodes are arranged respectively upstream and downstream of the two graphite electrodes in the current supply sections. Part of the asymmetrical alternating waveform current is supplied to the auxiliary anode electrodes so that a current causing an anode reaction on the graphite electrode surfaces is smaller than the current causing a cathode reaction thereon.

DESCRIPTION OF THE PREFERRED EMBODIMENTS

The invention will now be described in more detail with reference to the accompanying drawings.

Figure 1:
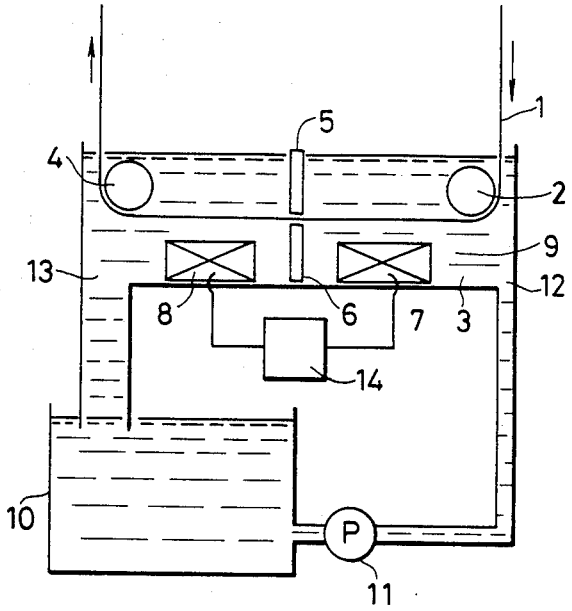
FIG. 1 PRIOR ART
FIG. 1 is an explanatory diagram schematically showing an example of a conventional continuous electrolytic treatment apparatus.
Figure 3:
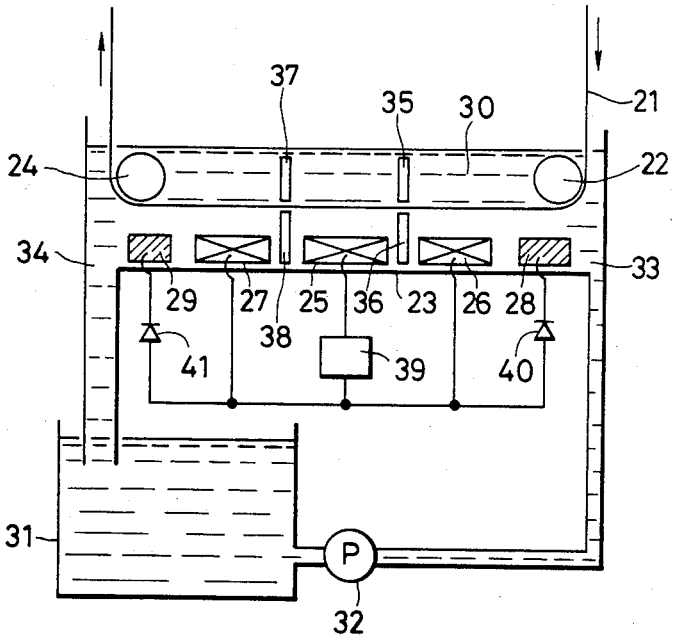
FIG. 3 is an explanatory diagram schematically showing an example of a continuous electrolytic treatment apparatus which utilizes an electrolytic treatment method of the invention.

FIG. 3 illustrates an example of an apparatus which can be used to perform continuous electrolytic treatment of a metal web according to an electrolytic treatment method of the invention. A metal web 21 is led into an electrolytic cell 23 by a guide roll 22 and is conveyed out of the electrolytic cell by a guide roll 24. A graphite electrode 25 in the treatment section of the cell is arranged at the center of the electrolytic cell 23 confronting the metal web 1. Graphite electrodes 26 and 27 in the current supply sections are disposed respectively upstream and downstream of graphite electrode 25 in the direction of movement of the metal web 21. Furthermore, auxiliary anodes 28 and 29 in the current supply sections are arranged respectively upstream and downstream of the graphite electrodes 26, 27. The auxiliary anode electrodes 28 and 29 are insoluble anode electrodes made of platinum or lead, for instance.

In a conventional manner, electrolyte from a circulating tank 31 is supplied to an electrolyte supplying port in the electrolytic cell by a pump 32 or the like so that the metal web and the electrodes are covered by the electrolyte. The electrolyte thus supplied is returned to the circulating tank 31.

Further in FIG. 3, reference numerals 35, 36, 37 and 38 designate insulators; and 39, an asymmetrical waveform power source.

The forward (positive half cycle) current value $I_N$ of the power source 39 is larger than the reverse (negative half cycle) current value $I_R$ of the power source 39 ($I_N > I_R$). The positive terminal of the power source 39 is connected directly to the graphite electrodes 26 and 27 in current supply sections, and is connected through thyristors or diodes 40 and 41 to the insoluble anode electrodes 28 and 29. The negative terminal of the power source 39 is connected to the treatment section graphite electrode 25. Control is effected such that, under the condition that $I_N = I_R + \alpha (\alpha > 0)$ is established, the following relations are satisfied:

$$I_N(6) = I_N(7),$$

$$I_N(8) = I_N(9), \text{ and}$$

$$\alpha < I_N(8) + I_N(9),$$

where $I_N(6)$ and $I_N(7)$ are the values of the forward currents flowing in the graphite electrodes 26 and 27, respectively, and $I_N(8)$ and $I_N(9)$ are the values of the forward currents flowing in the insoluble anode electrodes, namely, the auxiliary anode electrodes 28 and 29, respectively. Such control may be achieved by employing variable resistors in the circuit, by controlling the on times of thyristors, or by appropriate setting of the distances between the metal web 21 and the electrodes 26, 27, 28 and 29 or the lengths of the electrodes.

The forward current $I_N$ flows from the four electrodes through the metal web 21 to the treatment section graphite electrode 25. On the other hand, the reverse current $I_R$ flows from the graphite electrode 25 through the metal web 21 to the graphite electrodes 26 and 27. If it is assumed that, in this case, if the currents flowing to the graphite electrodes 26 and 27 are represented by $I_R(6)$ and $I_R(7)$, respectively, then $I_R(6) = I_R(7) = (\frac{1}{2})I_R$. Accordingly, the rate of consumption of all graphite electrodes is reduced. Furthermore, since the electrodes are arranged symmetrically in the cell, the distribution of current in the metal web is uniform in the longitudinal direction, which results in a precision electrolytic treatment.

The reason why the stabilities of the electrodes are maintained will be described in more detail. With respect to the graphite electrodes 25, $I_a = I_R$ when it acts as the anode electrode, and $I_c = I_N$ when it acts as the cathode electrode, and therefore $I_a < I_c$. With respect to the graphite electrode 26, $I_a = I_N(6) = (\frac{1}{2})(I_N - (I_N(8) + I_N(9))$, and $I_c = I_R(6)$. $I_R = I_N - \alpha$ and $(I_N(8) + I_N(9)) > \alpha$. Therefore, $I_R(6) = (\frac{1}{2})(I_N - \alpha) > I_N(6)$. Accordingly, $I_a < I_c$. The same is true for the graphite electrode 27. In the case of the auxiliary anode electrodes, which are insoluble anode electrodes as described above, only forward currents flow therein due to the presence of the thyristors or diodes, and hence they act as anode electrodes at all times. Therefore, the stability of the auxiliary anode electrodes is maintained.

One of the features of the invention resides in the provision of the auxiliary anode electrodes to allow a part of the asymmetric waveform current to flow therethrough, whereby control is made so that the current $I_c$ causing a cathode reaction on all graphite electrode surfaces is larger than the current $I_a$ causing an anode reaction thereon, whereby consumption of the graphite electrodes is substantially eliminated.

Another feature of the invention resides in that, as the electrodes are arranged symmetrically in the electrolytic cell, the distribution of current is uniform in the longitudinal direction, which yields an electrolytic treatment of high precision. Furthermore, an imbalance of current in the longitudinal direction on the graphite electrode surfaces is avoided, as a result of which the graphite electrode stabilizing condition is readily achieved.

Figure 4:
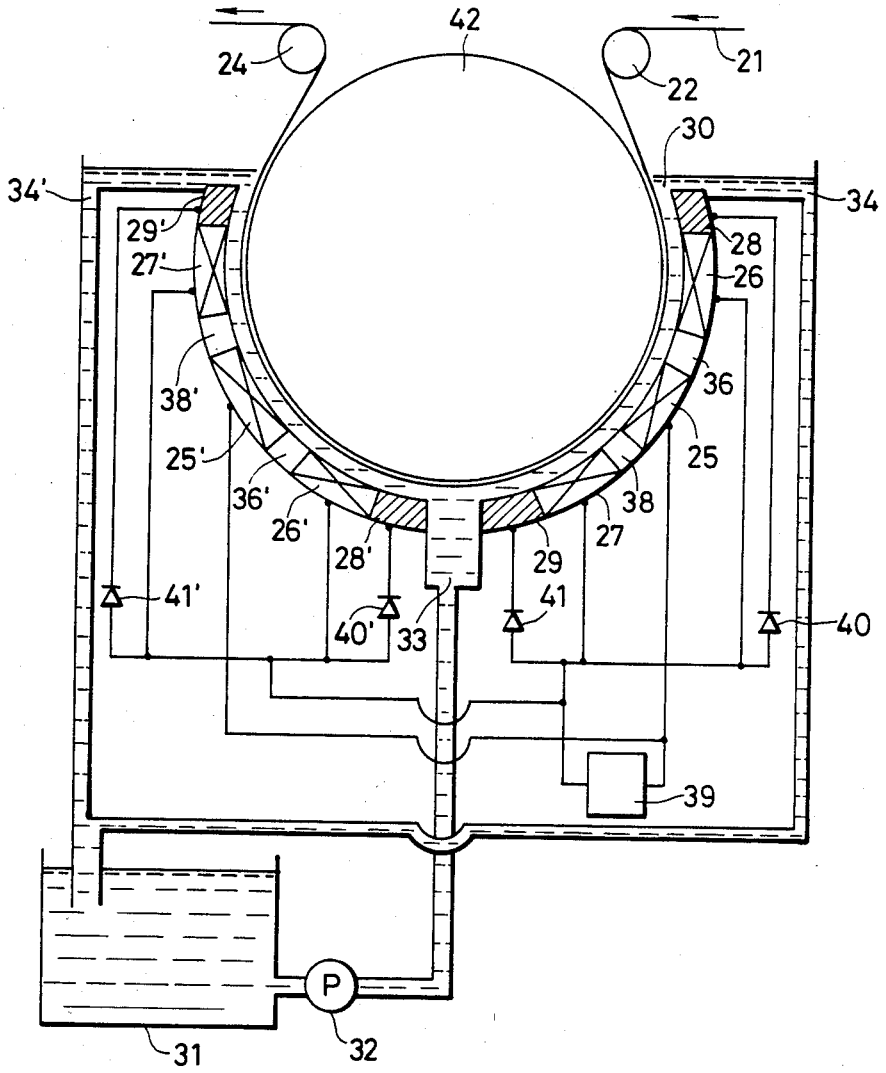
FIG. 4 is an explanatory diagram schematically showing an example of an electrolytic treatment apparatus according to the invention.

FIG. 4 shows an electrolytic treatment apparatus obtained by applying the method of the invention to a radial cell. In other words, this embodiment is a radial type electrolytic treatment apparatus in which, according to the invention, an electrolytic supplying section 33 is arranged below a backing roll 42, and an electrode unit composed of a treatment section graphite electrode 25, current supply section graphite electrodes 26 and 27, and auxiliary anode electrodes 28 and 29, and an electrode unit composed of a treatment section graphite electrode 25', current supply section graphite electrodes 26' and 27', and auxiliary anode electrodes 28 and 29 are arranged along a downward path and an upward path, respectively, of a metal web 21 which runs along the drum roll 42.

In FIG. 4, reference numerals 34 and 34' designate overflow ports; 36, 38, 36' and 38', insulators; and 40, 40', and 41', thyristors or diodes. Other components are the same as in FIG. 3.

In the electrolytic treatment apparatus shown in FIG. 4, the metal web 21 passes around the drum roll 42, which may have a surface made of rubber. Therefore, the rear side of the metal web 21 is electrically shielded so that diffusion of current to that part is completely prevented. In addition, the distances between the metal web and the electrodes are precisely maintained even if tension variations occur.

These effects contribute greatly to controlling the distribution of current to the electrodes and to the uniform distribution of current in the longitudinal direction, which are specific features of the invention. In the case of the radial cell, the metal web is stable in its running position, and therefore the distance between the metal web and the electrodes can be set to an extremely small value. If in fact the distance between the metal web and the electrodes is set to an extremely small value, the insulators 36, 36', 38 and 38' should be inserted between the respective graphite electrodes, as shown in FIG. 4. In this case, the amount of current which flows between the graphite electrodes through the electrolyte instead of through the metal web and which is not effective in electrolytic treatment can be minimized. For instance, when an aluminum web of 0.2 mm thickness and 300 mm in width is subjected to electrolytic polishing in a 1% HCl electrolytic bath using a graphite electrode of length 600 mm, insulator length of 100 mm, distance between the web and the electrodes of 10 mm, and current density of 30 A/dm$^2$, the ineffective current is limited to less than 0.5% of the total current. Thus, the graphite electrode current control accuracy is much improved with the invention, and the loss of power in the cell reduced, as a result of which the operating costs of the apparatus are reduced.

A specific example of the method and apparatus of the invention will now be described.

EXAMPLE

Figure 2:
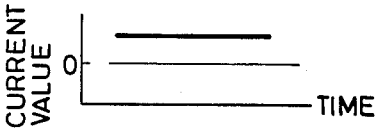
FIG. 2 is a diagram showing various current waveforms.
Figure 2:
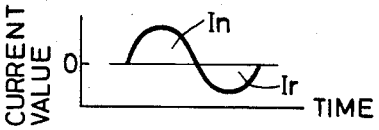
Figure 2:
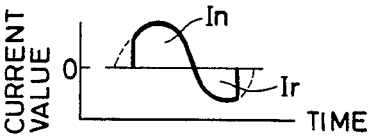
Figure 2:
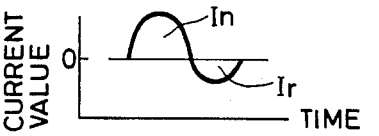
Figure 2:
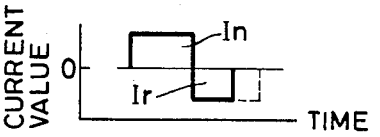
Figure 2:
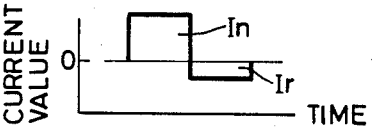

In order to form an offset printing plate support, an aluminum plate was subjected to a continuous electrolytic graining treatment with an electrolytic treatment apparatus of the type shown in FIG. 4. In this treatment, a 1% nitric acid solution at 35° C. was used, and an asymmetric waveform alternating current as shown in part (6) of FIG. 2 was employed. The electrodes 25, 26, 27, 25' and 27' were graphite electrodes, and the current supply section auxiliary anode electrodes 28, 29, 28' and 29' were insoluble anode electrodes made of platinum. After continuous electrolytic treatment was carried out for twenty hours with $I_N$=1000 A and $I_R$=900 A, and a treatment speed of 4 mm/M, surfaces of the graphite electrodes 25, 26, 27, 25', 26' and 27' were visually inspected for consumption. The desired distribution of current to the current supply section graphite electrodes 25 and 25' and the current supply section auxiliary anode electrodes 28, 29, 28' and 29 were achieved by inserting resistors in the circuit. The sum $\beta$ of the currents distributed to the four auxiliary anode electrodes 28, 29, 28' and 29' was varied among 50A, 100A, 200A and 300A, with $(\frac{1}{4})\beta$ per electrode. The frequency was varied in the range of 30 to 90 Hz. Irrespective of frequency variations, the relations between $I_a$ and $I_c$ and the consumptions of the graphite electrodes were as indicated in the Table below:

TABLE

| Condition No. | Supply current value $I_N$ (A) | $I_R$ (A) | $\beta$ (A) | Current supply section graphite electrodes: Relation between $I_a$ and $I_c$ | Consumption 26 | 27 | 26' | 27' | Graphite electrodes in current supply section: Relation between $I_a$ and $I_c$ | Consumption 25 | 25' |
|---|---|---|---|---|---|---|---|---|---|---|---|
| 1 | 1000 | 900 | 50 | $I_a > I_c$ | X | X | X | X | $I_a < I_c$ | O | O |
| 2 | " | " | 100 | $I_a = I_c$ | Δ | Δ | Δ | Δ | " | O | O |
| 3 | " | " | 200 | $I_a < I_c$ | O | O | O | O | " | O | O |
| 4 | " | " | 300 | $I_a < I_c$ | O | O | O | O | " | O | O |

Legend:
O: No change - no consumption
Δ: Slight consumption
X: Extreme consumption - surface collapsed Operating under conditions No. 3 and 4, offset printing plate supports having an excellent graininess were obtained.

As is apparent from the above description, the consumption of the electrodes is greatly decreased through the use of the invention. Therefore, a continuous high efficiency electrolytic treatment can be performed, and the electrolytic treatment can be stably achieved. In addition, frequent inspection and maintenance of the electrodes are not needed, and manufacturing costs can accordingly be reduced.

While several embodiments of the invention have been illustrated and described, it is to be understood that the invention is not limited thereto or thereby and various changes and modifications can be made therein.

We claim:

1. A method of electrolytic treatment employing graphite electrodes wherein an asymmetrical waveform alternating current is applied to said electrodes to subject a metal article to continuous electrolytic treatment, comprising the steps of:

providing first graphite electrode means arranged confronting said metal article;

providing second and third graphite electrode means arranged respectively upstream and downstream of said first graphite electrode with respect to a direction of movement of said metal article;

providing auxiliary anode electrode means arranged respectively upstream and downstream of said second and third graphite electrode means; and supplying a part of said asymmetrical waveform alternating current to said auxiliary anode electrode means so that a current causing a cathode reaction on surfaces of said graphite electrodes is larger than a current causing an anode reaction thereon.

2. The method of electrolytic treatment of claim 1, wherein said first, second and third graphite electrode means and said auxiliary anode electrode means are arranged linearly.

3. The method of electrolytic treatment of claim 1, wherein said first, second and third graphite electrode means and said auxiliary anode electrode means are arranged along a curved path parallel to a surface of a backing roll and extending parallel to a longitudinal axis of said backing roll.

4. The method of electrolytic treatment of claim 1, wherein a distance between said metal article and said electrode means is not more than 10 mm.

5. The method of electrolytic treatment of claim 1, wherein insulators are disposed between each of said second and third graphite electrode means and said first graphite electrode means.

6. An electrolytic treatment apparatus of the type employing graphite electrodes wherein an asymmetrical waveform alternating current is applied to said electrodes to subject a metal article to continuous electrolytic treatment, comprising:

first graphite electrode means arranged confronting said metal article;

a second and third graphite electrode means located respectively upstream and downstream of said first graphite electrode with respect to a direction of movement of said metal article;

auxiliary anode electrode means arranged respectively upstream and downstream of said second and third graphite electrode means; and means for supplying a part of said asymmetrical waveform alternating current to said auxiliary anode electrode means so that a current causing a cathode reaction on surfaces of said graphite electrodes is larger than a current causing an anode reaction thereon.

7. The apparatus for electrolytic treatment of claim 6, wherein said first, second and third graphite electrode means, and said auxiliary anode electrode means are arranged linearly.

8. The apparatus for electrolytic treatment of claim 6, wherein said first, second and third graphite electrode means and said auxiliary anode electrode means are arranged along a curved path parallel to a surface of a backing roll and extending parallel to a longitudinal axis of said backing roll.

9. The apparatus for electrolytic treatment of claim 6, wherein a distance between said metal article and said electrode means is no more than 10 mm.

10. The apparatus for electrolytic treatment of claim 6, further comprising insulators disposed between each of said second and third graphite electrode means and said first graphite electrode means.

* * * * *